United States Patent [19]

Südbeck et al.

[11] Patent Number: 4,526,521

[45] Date of Patent: Jul. 2, 1985

[54] ROTARY SPIRAL WALL PUMP WITH PIVOTABLY CONNECTED GUIDE MEANS AND ASSOCIATED METHOD

[75] Inventors: Rainer Südbeck, Wassenberg; Hans Baumgartner, Viersen; Manfred Brandstädter, Dusseldorf, all of Fed. Rep. of Germany

[73] Assignee: Pierburg GmbH & Co., Neuss, Fed. Rep. of Germany

[21] Appl. No.: 526,154

[22] Filed: Aug. 24, 1983

[30] Foreign Application Priority Data

Aug. 26, 1982 [DE] Fed. Rep. of Germany ..... 3231756

[51] Int. Cl.[3] ..... F04C 2/04

[52] U.S. Cl. ..... 418/55; 418/59

[58] Field of Search ..... 418/55, 59

[56] References Cited

U.S. PATENT DOCUMENTS

| | | | |
|---|---|---|---|
| 15,641 | 9/1856 | Carmichael | 418/59 |
| 2,783,714 | 3/1957 | Straatveit | 418/59 |
| 2,841,089 | 7/1958 | Jones | 418/55 |

FOREIGN PATENT DOCUMENTS

| | | | |
|---|---|---|---|
| 532971 | 9/1931 | Fed. Rep. of Germany | 418/59 |

*Primary Examiner*—John J. Vrablik

*Attorney, Agent, or Firm*—Posnack, Roberts, Cohen & Spiecens

[57] ABSTRACT

A positive displacement rotary pump based on the spiral principle in which the piston is given a complex orbital motion by a crankshaft drive, the piston being also pivoted to a second guide element, this pivot point reciprocating along an open path. The second guide element is constructed to provide compactness and ease of manufacture.

9 Claims, 10 Drawing Figures

ROTARY SPIRAL WALL PUMP WITH PIVOTABLY CONNECTED GUIDE MEANS AND ASSOCIATED METHOD

FIELD OF THE INVENTION

The invention relates to a positive displacement rotary pump for fluids having a piston with at least one spiral wall operating in a housing which also has a spiral wall, the piston being driven by a crankshaft and guided by a guide member so that the piston has a pumping action in the housing. The invention also relates to methods of driving the piston to produce the pumping action.

PRIOR ART

Pumps of this general kind convey the fluid in a unidirectional stream and the piston surface travels comparatively slowly relative to the cooperative cylinder surface of the housing. Consequently, these pumps are particularly suitable for use as gas compressors and vacuum pumps, where it is desired to achieve a high compression ratio with little need for lubrication, or without any lubrication at all.

But the manufacture of pumps of this kind requires precision dimensioning of the radial clearance gap between the spiral wall of the piston and the spiral wall of the housing, to prevent rapid abrasion with local overheating of the spiral walls, which can even cold-weld them to each other during operation of the pump.

In conventional pumps of this type, operating on the spiral principle, a double or multiple crankshaft drive imparts a translatory-circular movement to the piston. But, due to manufacturing tolerances, it is difficult to ensure that the piston (corresponding to a connecting rod) moves precisely parallel to the housing (corresponding to a frame). The double crankshaft drive corresponds to a four pivot linkage in which, when all the links are at a top or bottom dead center, the pivot points are all on a straight line. From this situation there are two possibilities of movement, i.e. there is no longer positive drive. Due to manufacturing tolerances, the links of the drive system, i.e. the frame (or housing), the connecting rod (or piston) and the swing arms (the crank arms) are subjected to longitudinal stresses which can place severe loads on the materials of the bearings. It has been proposed to remedy the matter, for example, by great precision in manufacture, or by using an adjustable crank drive or, as can be found in German Offenlegungsschrift No. 28 31 179, by using a flexible support for the piston so that it can deviate in position, within limits, to allow for imprecisely parallel movements, imprecise piston shape and thermal distortion, without this impairing the performance of the pump.

All these proposed solutions involve high manufacturing costs. In a pump which rotates rapidly without lubricant, the piston not making full contact with the housing, a small clearance remaining between the two surfaces, a flexible mounting for the piston cannot be used because at certain speeds, depending on the moving masses and on the resilience of the parts, the piston can engage in oscillations which could damage the machine.

SUMMARY OF THE INVENTION

An object of the present invention is to provide a pump operating on the spiral principle which can be driven in rotation at high speeds without lubricant and in which the high stresses on the materials of construction and on the bearings, due to manufacturing tolerances, do not occur.

The above and other objects are satisfied according to the invention, in that the center of rotation of the piston on an eccentric crankshaft stub moves along a closed circular path, whereas the pivot point where the piston is pivoted to a second guide element reciprocates along an open path, the second guide element being a doubly pivoted swing arm which is pivoted, at one end, to the housing and, at its other end, to the piston, the length of the swing arm, between the two pivot points, being greater than the length of the crank arm.

The second guide element in another embodiment can be an axial guide rotatably mounted in the housing and sliding along a guide rod of the piston or, alternatively, the second guide element can be a guide rod of the housing which is slidable in a slot in the piston or, as a further alternative, the second guide element is a rib of the piston sliding in a slot in the housing.

The spiral wall of the piston can project axially from a transverse plate of the piston, the transverse plate supporting a hub in which rotates the eccentric stub shaft of the crankshaft.

In a further aspect of the invention, the transverse plate joins the ends of the spiral wall of the piston radially, in which case a gap between the piston and the housing which varies with the movements of the piston, is minimized by the construction of the guide element, the cooperating surfaces nevertheless not touching each other. The widths of the axial gaps are determined by the dimensions of the pump, whereas the widths of longitudinal gaps are limited by confronting circularly curved surfaces of the housing, of the swing arm and of the piston.

By reason of the invention, a number of advantages are obtained, namely, that the piston is driven by a crankshaft in such a way that none of the stresses which are applied to the construction materials and to the bearings in the conventional pumps due to manufacturing tolerances can occur. The pump of the present invention can therefore be manufactured using only the usual precision of manufacture. The parts of the pump are comparatively small and the pump has a long working life. The inertial masses or intermediate wheels or belts connecting the cranks which are necessary in conventional pumps to prevent reversal are not required in the present invention because the piston is driven positively at all positions by a crankshaft cooperating with a swing arm.

Drives of this kind are known in machines with rotary pistons, but not in positive displacement rotary pumps based on the spiral principle.

This type of drive makes it possible to manufacture a pump which is more compact than the known pumps, because the crank arm situated outside the housing chamber determined by the path of movement is replaced, in the present invention, by a simple bearing which allows the diameter of the pump to be reduced by at least twice the length of the crank arm. Furthermore, the transverse plate which is supported by the hub and joins the spiral piston walls radially agains allows the diameter of the pump to be reduced by twice the crank arm length, this being made possible by the sealing action of the second guide element, which is pivoted to the piston.

The invention will now be described in greater detail with reference to the appended drawing.

DETAILED DESCRIPTION

Figure 1:
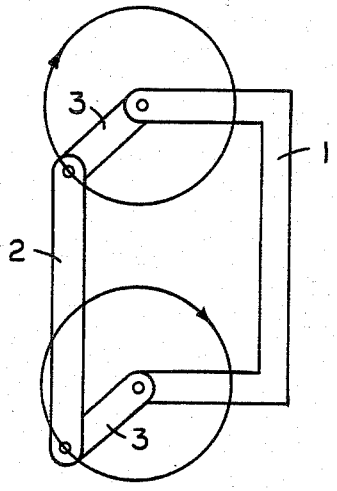
FIG. 1 PRIOR ART
FIG. 1 diagrammatically shows a drive according to the prior art.

FIG. 1 diagrammatically illustrates a conventional drive system for a positive displacement pump operating on the spiral principle, the drive system being a four pivot linkage known as a double swinging arm system. The drive system comprises a frame 1 (corresponding to a housing), a connecting rod 2 (corresponding to a piston) and two swing arms 3, the drive system giving the connecting rod 2 (or piston) a translatory circular movement.

Figure 2:
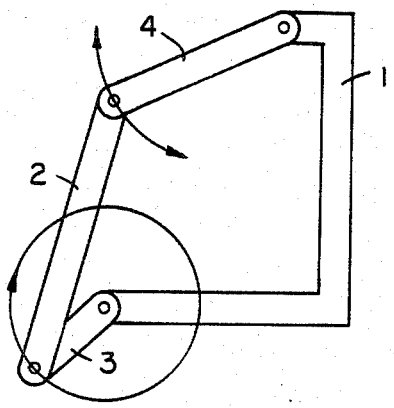
FIGS. 2 to 4 diagrammatically show drives according to the present invention.

FIG. 2 shows the drive system of the present invention, with a four pivot linkage comprising a first swing arm 3, which rotates over a full circle, and a second swing arm 4, which guides one end of the connecting rod 2 to reciprocate along an open arcuate path.

Figure 3:
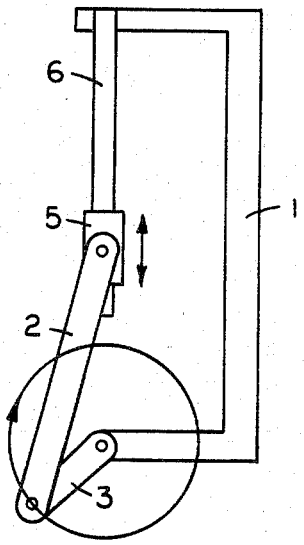

FIG. 3 shows a modified drive system of the present invention, in which one end of the connecting rod 2 is guided by a sliding sleeve 5 to reciprocate on a straight line, the sleeve 5 sliding on a guide rod 6 fixed to the frame 1 of the pump, the sleeve 5 being pivoted to the connecting rod 2.

Figure 4:
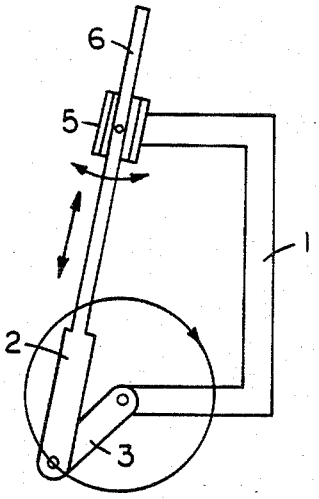

FIG. 4 represents a reversed arrangement in which the guide rod 6 is fixed to the connecting rod 2, the sleeve 5 being pivoted to the frame 1.

The drive systems shown in FIGS. 2, 3 and 4 satisfy the requirements for driving the piston in the pump of the present invention.

Figure 5:
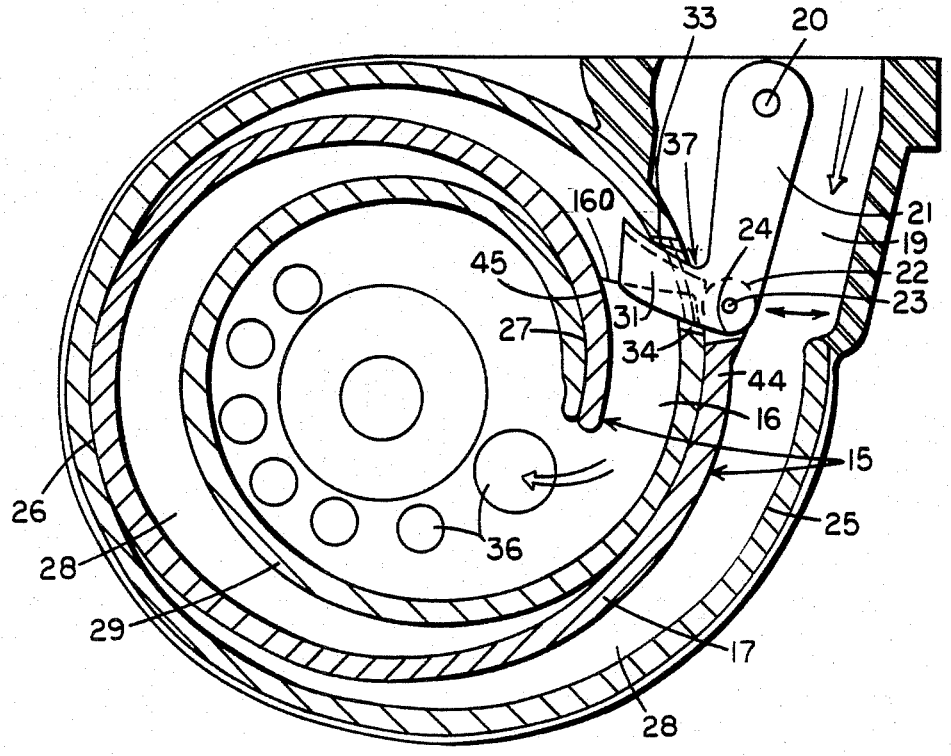
FIG. 5 is a cross-section through the spiral orbiting piston and the spiral housing wall of the pump of the invention.
Figure 6:
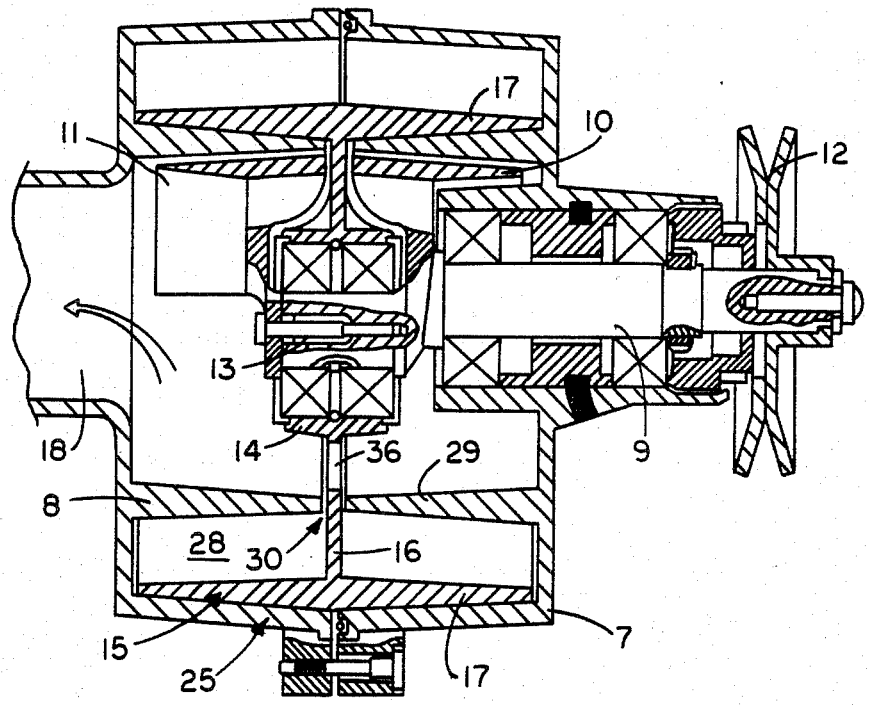
FIG. 6 is a longitudinal sectional view through the structure in FIG. 5.

FIG. 5 is a cross-section through the pump of the present invention embodying the drive system of FIG. 2 and FIG. 6 is a longitudinal section therethrough. The pump comprises a housing with two housing halves 7 and 8. Of these, the housing half 7 supports a bearing in which rotates a crankshaft 9 driven by a pulley 12 for a belt and equipped with balancing masses 10, 11. An eccentric stub shaft 13 of the crankshaft 9 rotates in the hub 14 of a piston 15, which comprises a transverse central plate 16 and, projecting longitudinally from both sides of plate 16, a spiral piston wall 17. The housing half 8 has an axial pump outlet (or inlet) connection 18 leading to a utilization device (not shown). A tangential pump inlet (or outlet) connection 19, extends tangentially to the outer periphery of the housing and is formed by the two housing halves 7 and 8. The tangential pump inlet 19 houses a doubly pivoted swing arm 21, which is pivoted at one end by a pivot pin 20 to the housing halves 7, 8. The other end of the swing arm 21 is pivoted to the piston 15 by a pivot pin 23 which is supported in a double bearing 22 of the piston 15, the double bearing 22 being situated radially outwards of the spiral piston wall 17.

The spiral piston wall 17 extends over an angle of more than 360° and cooperates with a spiral housing wall 25 which also extends over an angle of more than 360°. When the pump is operating, the rotational center of the piston 15, i.e. the center of its hub 14, is driven by the eccentric stub shaft 13 to orbit on a closed circular path. The pivoting center of the piston 15, i.e. the center of its pivot pin 23, is guided by the swing arm 21 to reciprocate along an open arcuate path. In consequence of this complex movement, the spiral piston wall 17 constantly makes linear near contact (although still leaving a small gap) with the spiral housing wall 25 at at least two locations 26 and 27, so that there are formed crescent-shaped pumping chambers 28 which convey the fluid along, always in one direction.

It will be observed that upon rotation of the eccentric stub shaft 13, both internal and external pumping chambers 28 are formed, i.e. one formed by the inner surface, the other by the outer surface of the spiral piston wall 17 so that the fluid is conveyed continuously. The transverse central plate 16 has outlet ports 36 which are positioned so that they never move radially beyond the inner chamber formed by the inner portion 29 of the housing wall 25. Furthermore, the spiral wall 25 of the housing is axially slotted in the region of its inner portion 29, as shown at 30 in FIG. 6, to provide room for the thickness of the transverse central plate 16. The surface of the plate 16 nevertheless does not quite make contact with the housing wall 29 and a small clearance still remains between the two surfaces. As seen in the cross-sectional view of FIG. 5, the spiral piston wall 17 has an inlet end 44 and an outlet end 45, the transverse central plate 16 bridging between the two ends and having a radial terminal edge 160. At this location there is a longitudinal gap or clearance between the edge 160 of the transverse central plate 16 and the spiral housing wall 25, the gap varying in width with the movements of the piston 15. This gap must be obturated to prevent fluid from escaping from the compression pumping chamber to the suction pumping chamber. If the transverse central plate 16 were to extend radially out beyond the spiral piston wall 17 everywhere far enough to seal the compression pumping chamber 28 at all positions of the piston 15, this obturation would be unnecessary. But a penalty would be that the piston 15 and the housing 7, 8 would have to be made considerably larger. In the present embodiment of the invention the gap is obturated by the swing arm 21, by the housing halves 7, 8 in the region of the pump inlet 19 and by the piston 15 in the region of the double bearing 22. In this region, all the cooperating surfaces of the longitudinal gaps have circularly curved surfaces, the axial gaps, which remain constant in width, being determined by the dimensions of the pump.

As a result of these arrangements, a fork end 31 of the swing arm 21 projects inwards into the pumping chamber 28.

The gaps between the opposite, cooperating surfaces are minimized by curving the surfaces circularly on constant radii at the following locations: where the longitudinal walls 33, 34 of the opening 37 cooperate with the angled fork end 31 of the swing arm 21; where the bearing eye surface 24 of the swing arm 21 cooperates with the inlet end 44 of the spiral piston wall 17 and where the surface of the transverse central plate 16 cooperates in the fork slot 35 with the bearing eye surface 24.

Figure 7:
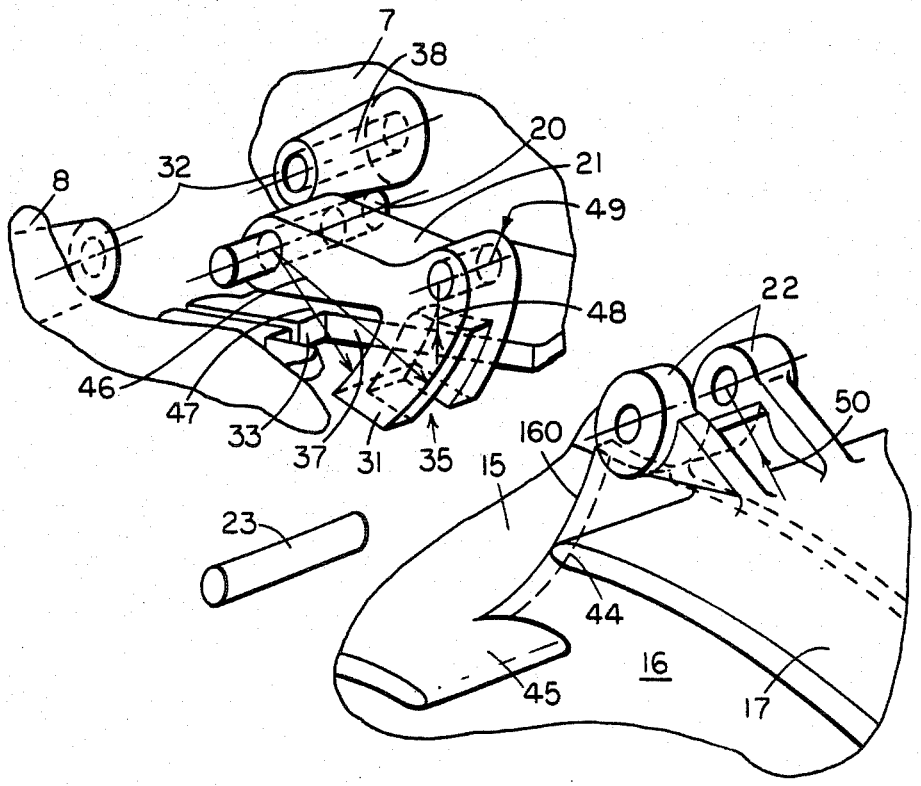
FIG. 7 is an exploded view showing a second piston guide element in the form of a swing arm.

The exploded view of FIG. 7 shows, indicated by thin lines, the two housing halves 7 and 8 from which there project inwards, housed in the tangential pump inlet 19, bushes 32 containing bores 38 in which rotates the pivot pin 20 for the swing arm 21. The figure also shows the opening 37 in the housing walls 7 and 8, through which penetrates the angled fork end 31 of the swing arm 21. The figure furthermore shows the pivot pin 20 and the swing arm 21 with its forked end 31 containing the slot 35; the several radii 46, 47, 48, 49, 50 of the circularly curved cooperating surfaces of the gaps or clearances, radius 46 extending to the curved lower surface of fork end 31, radius 47 extending to the curved upper surface of fork end 31, radius 48 extending to the curved surface at the base of slot 35, radius 49 extending to the bearing eye surface 24 of the swing arm 21, radius 50 extending to the inlet end 44 of the spiral piston wall 17; the orbiting piston 15 supporting the double bearing 22 in which the swing arm 21 pivots on pivot pin 23. The figure also shows the transverse central plate 16 where it bridges between the inlet end 44 and the outlet end 45 of the spiral piston wall 17, this portion of the transverse central plate 16 engaging in the slot 35 of the fork end 31.

Figure 8:
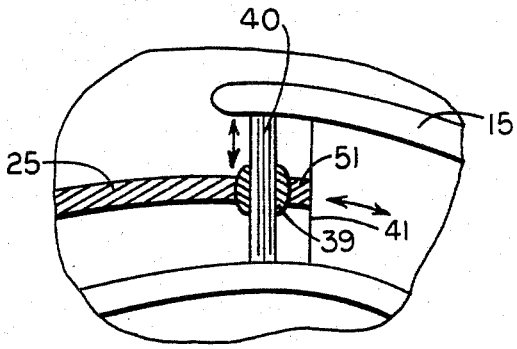
FIGS. 8 to 10 show alternative arrangements of the second piston guide element.

FIG. 8 illustrates an alternative arrangement of the second piston guiding element based on the drive system of FIG. 4. A guide rod 40 bridges between the inlet and outlet ends of the piston 15, the guide rod 40 reciprocating in a spherical bush 39 rotatably mounted in the spiral housing wall 25. The arrangement can, if desired, be reversed by fixing the guide rod to the spiral housing wall and mounting the spherical bush in the piston 15. In this case the gap is minimized by forming a circularly curved surface 51 of constant radius on the end of the spiral housing wall 25, the transverse central plate 16 of the piston 15 terminating in a straight end 41 parallel to the guide rod 40.

Figure 9:
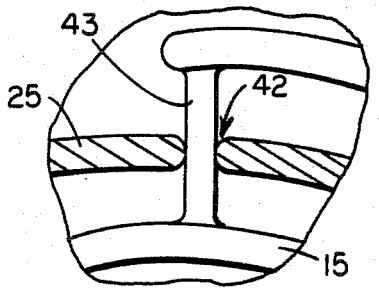

In FIG. 9 a rib 43 projects axially from both sides of the transverse central plate 16, the rib sliding in a guide slot 42 in the spiral housing wall 25. To minimize the clearances, the rib 43 has concave side surfaces.

Figure 10:
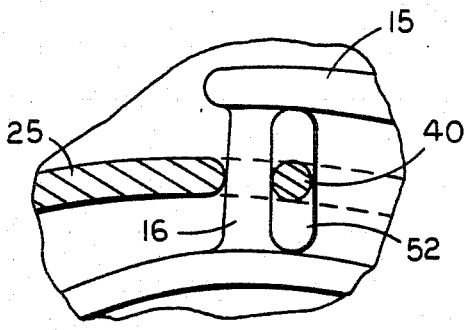

In FIG. 10 the transverse central plate 16 is provided with a radial guide slot 52 having parallel sides. Projecting axially from the housing is a guide rod 40 which reciprocates in the guide slot 52. The end of the transverse central plate 16 has a concave curvature to minimize the clearance between this end and the end of the spiral housing wall 25.

Other alternative constructions are possible, based on the drive systems represented in FIGS. 3 and 4, but these need not be described in detail here.

In the pump of the invention, the rotary piston does not make contact, during operation of the pump, with the housing wall, and a small clearance remains between the two, the width of the clearance being determined by the dimensions of the parts of the pump. If desired, sealants can be used, such as pastes, plastic coatings or the like, to reduce the clearance still further. The balancing masses 10, 11 provide both static and dynamic balancing. It is perfectly possible to reverse the direction of conveying of the fluid, if desired, either by driving the piston to rotate in the opposite direction, or by reversing the input and output connections. The pump is suitable for conveying gases, liquids or gas-liquid mixtures.

Although the invention has been described in relation to specific embodiment thereof, it will become apparent to those skilled in the art that numerous modifications and variations can be made within the scope and spirit of the invention as defined in the attached claims.

What is claimed is:

1. A positive displacement rotary pump for a fluid comprising a housing including a spiral wall, a piston including a spiral wall engaged in said spiral wall of said housing to form chambers therewith, said spiral wall of said piston extending over an angle greater than 360° to provide overlapping inlet and outlet ends, said piston further including a transverse plate from which said spiral wall extends axially on both sides of said transverse plate, said housing having a fluid inlet and a fluid outlet communicating with said chambers, and means for driving said piston within said housing to produce a pumping action on fluid in said chambers and convey the fluid from the inlet to the outlet, said means comprising an eccentric crankshaft pivotably connected to said transverse plate to drive the piston at a center of rotation along a closed circular path, and a swing arm pivotably connected to said housing at a first pivot axis and to said piston at a second pivot axis, said second pivot axis being spaced from said center of rotation by a distance greater than the radius of said closed circular path to cause said piston at said second pivot axis to undergo reciprocal movement along an open path, said transverse plate having a radial terminal edge extending between said overlapping inlet and outlet ends, said swing arm being connected to said piston at said second pivot axis at a location where the ends of the spiral wall overlap one another, said transverse plate being confined in its radial direction within the outline of the spiral wall of said piston.

2. A pump as claimed in claim 1 wherein said swing arm guides the piston for reciprocal movement along an arcuate path.

3. A pump as claimed in claim 1 wherein the spacing between the pivot axes of said swing arm to the housing and piston is greater than the radius of said closed circular path.

4. A pump as claimed in claim 1 wherein said piston further includes a hub on said transverse plate, said crankshaft including an eccentric stub shaft engaged in said hub to drive the piston along said circular path.

5. A pump as claimed in claim 1 in which said swing arm has a fork-end with a slot therein, said fork-end having a circularly curved outer surface whose center is located on said first pivot axis, said housing having an opening with complementary circularly curved inner surfaces through which said fork-end penetrates into the pumping chamber situated between the overlapping ends of said spiral wall of said piston, said radial terminal edge of said transverse plate being slidably engaged in said slot in said fork-end, said swing arm having a cylindrical extension with a circularly curved outer surface whose center is located on said second pivot axis, said circularly curved outer surface of said extension cooperating with a complementary circularly curved inner surface on said outlet end of said spiral wall of said piston.

6. A pump as claimed in claim 1 wherein said spiral wall of said housing has a radial opening with opposed, bounding walls, said radial terminal edge of said transverse plate extending in said radial opening and forming a gap with one of said bounding walls, said pump further comprising means on said swing arm entering into said chambers for obturating said gap.

7. A pump as claimed in claim 1 wherein said piston and the housing form a gap whose size varies with the movements of the piston, said swing arm and said piston and housing having confronting surfaces which do not contact one another and form said gap.

8. A pump as claimed in claim 7 wherein further gaps of fixed size are radially formed by said piston and housing, said confronting surfaces of said varying gap being circularly curved.

9. A pump as claimed in claim 8 wherein said confronting surfaces of circularly curved shape are provided on said piston, said housing and said swing arm.

* * * * *